United States Patent [19]

Cockrell

[11] 4,041,879

[45] Aug. 16, 1977

[54] SCHNABEL-TYPE CAR

[75] Inventor: Charles R. Cockrell, Chattanooga, Tenn.

[73] Assignee: Combustion Engineering, Inc., Windsor, Conn.

[21] Appl. No.: 636,498

[22] Filed: Dec. 1, 1975

[51] Int. Cl.[2] ..... B61D 3/12; B61D 3/14; B61D 3/16; B61D 45/00

[52] U.S. Cl. ..... 105/366 R; 105/367; 105/463; 105/469

[58] Field of Search ..... 105/366 R, 367, 463, 105/469

[56] References Cited

U.S. PATENT DOCUMENTS

| | | | |
|---|---|---|---|
| 3,532,061 | 10/1970 | Bohm | 105/367 X |
| 3,744,434 | 7/1973 | Patrick | 105/366 R X |
| 3,837,295 | 9/1974 | Fedele | 105/367 |

FOREIGN PATENT DOCUMENTS

| | | | |
|---|---|---|---|
| 1,274,615 | 8/1968 | Germany | 105/367 |

*Primary Examiner*—Robert J. Spar
*Assistant Examiner*—Howard Beltran
*Attorney, Agent, or Firm*—Wayne H. Lang

[57] ABSTRACT

A shipping and handling fixture for a large rigid load such as a steam generator or other vessel in which the fixture is incorporated with the load to provide a carrier having wheeled sections at opposite ends thereof that comprises a vehicle commonly known as a Schnabel-type railway or over-the-road car. The handling fixture includes a longitudinal support skid that underlies the vessel and is held in tension between wheeled sections of the car while the vessel itself becomes a stuctural part of the carrier that transmits compressive forces between oppposite ends of the car.

7 Claims, 1 Drawing Figure

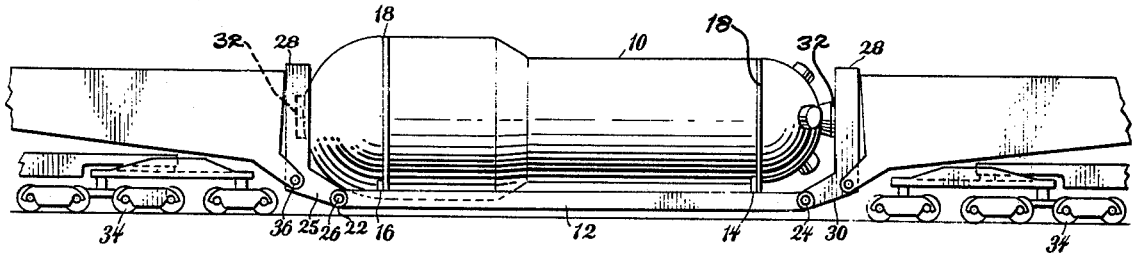
18
32
28
10
18
32
28
34
36
25
26
22
16
12
14
24
30
34

SCHNABEL-TYPE CAR

BACKGROUND OF THE INVENTION

1. Field of the Invention

This application relates to a Schnabel-type vehicle in which a car having independent fore and aft wheeled sections are secured to opposite ends of an elongate rigid load whereby the load is supported between the two wheeled sections to become an integral part of the car. When the load has arrived at its destination, it is removed from the carrier and the wheeled sections are jointed together to form a unitary car that may be returned to its point of origin for further use.

2. Description of Prior Art

In a typical Schnabel-type car a rigid load to be transported is connected at opposite ends thereof to each of the bottom edges of confronting sections of wheeled cars to maintain the bottom of the load in continuous tension. Compression pads are then provided on each car section to bear against the upper marginal edge of the load to maintain the top of the load in continuous compression. A load carried in this manner is in continuous tension at the lower portion thereof, and in compression along the portion thereof that lies on the opposite side of a neutral axis. Thus, a significant bending moment is imposed on the load itself, and handling difficulties arise because of the absence of any structure that might support the load during storage or shipping when it is separated from the car.

This arrangement is generally shown in U. S. Pat. No. 3,532,061. In this patent a heavy load is carried in tension at its lower edge and in compression along its upper edge thereof with no support member underlying the load. While such apparatus is satisfactory for the transportation of a certain type of heavy load, such a load is difficult to handle, and an excessive bending force is imposed upon certain loads such as steam generating or reactor vessels.

SUMMARY OF THE INVENTION

The present invention is accordingly directed to a Schnabel-type car having fore and aft wheeled sections with a longitudinal skid supporting a load therebetween. The skid is pivotally attached to the wheeled car sections and includes a plurality of support pads between ends thereof that support the load and minimizes the bending moment imposed thereon. The skid is firmly attached to the load and is thus adapted to facilitate handling at all times during storage, railway or over-the-road transportation, marine transportation, and during final assembly.

BRIEF DESCRIPTION OF THE DRAWING

For a better understanding of the nature and objectives of my invention, reference may be had to the following detailed description taken in conjunction with the accompanying drawings in which:

The FIGURE is a side elevation of the divided car in accordance with the present invention.

DETAILED DESCRIPTION

Referring more particularly to FIG. 1 of the drawing a steam generator 10 or other large load is supported in a horizontal position upon an elongate skid 12 by means of a plurality of support pads 14. The support pads and load thereon may be elevated to a suitable position by the use of hydraulic jacks pressing against the jacking pads 16. Wire, cables or bands 18 encircle the load at opposite ends of the skid and suitably secure the load to the skid adjacent each support pad 14.

Each skid 12 is provided with a large lug 22 at opposite end portions having an opening 24 therein that may be attached to a similar opening in horizontal arms 25 of bell-cranks 30 by pivot pins 26. Each bell-crank includes a vertical arm 28 having a bearing pad 32 adapted to transmit a compressive force to the ends of the load itself that is dependent upon the downward force upon the skid exerted by the load.

Each bell-crank is also pivotally mounted on a wheeled section 34 of the car on a pivotal joint 36 whose axis lies parallel to that of pin 26 whereby vertical forces on skid 12 and the horizontal arm 25 on the bell-crank 30 produce a horizontal movement of vertical arm 28 and the compression pad 32 affixed thereto.

I claim:

1. A Schnabel-type car having independent wheeled sections at opposite ends that transport an elongate rigid load therebetween, an angular support means carried by each wheeled section in the form of a bell-crank including an upright arm and a horizontal arm, pivotal means at the intersection of the horizontal and vertical arms connecting each bell-crank to a wheeled section of the car, an elongate load carrying skid extending between wheeled sections of the car, means pivotally connecting the elongate skid to confronting ends of the horizontal arms, and compression pads on confronting surfaces of the upright arms adapted to contact the elongate rigid load supported on said skid whereby forces effected by the load bearing upon the skid are transmitted to the ends of the load through the compression pads.

2. A car in accordance with claim 1 wherein the pivotal means at the intersection of the horizontal and vertical arms of the bell-crank is disposed about a horizontal axis.

3. A car in accordance with claim 2 wherein the means pivotally connecting the elongate skid to ends of the horizontal arms is pivotal about an axis parallel to that of said bell-crank.

4. A car in accordance with claim 1 wherein the elongate skid is provided with a plurality of support pads that support a vertical load intermediate the ends thereof.

5. A car in accordance with claim 1 including means that secure the load to the elongate skid.

6. A car in accordance with claim 4 wherein the means that secure the load to the skid lie adjacent the support pads thereon.

7. A car in accordance with claim 1 wherein the compression pads on the upright arms of each bell-crank lie adjacent the neutral axis of the elongate load.

* * * * *